US005800252A

United States Patent [19]

Hyatt

[11] Patent Number: 5,800,252

[45] Date of Patent: Sep. 1, 1998

[54] FLUID-ACTIVATED VARIABLE HONING TOOLS AND METHOD OF USING THE SAME

[75] Inventor: Gregory Aaron Hyatt, West Chester, Ohio

[73] Assignee: Makino Inc., Mason, Ohio

[21] Appl. No.: 707,336

[22] Filed: Sep. 3, 1996

[51] Int. Cl.[6] ..... B24B 9/02

[52] U.S. Cl. ..... 451/61; 451/164; 451/180; 451/481; 451/505

[58] Field of Search ..... 451/51, 58, 59, 451/61, 124, 164, 168, 180, 462, 470, 464, 481, 504, 505

[56] References Cited

U.S. PATENT DOCUMENTS

| | | |
|---|---|---|
| 1,045,201 | 11/1912 | Shoop . |
| 1,444,314 | 2/1923 | Herder . |
| 1,951,998 | 3/1934 | Simonson . |
| 2,017,163 | 2/1935 | Reed . |
| 2,167,758 | 8/1939 | Johnson et al. . |
| 2,225,073 | 12/1940 | Miller . |
| 2,284,134 | 5/1942 | Connor . |
| 2,313,442 | 3/1943 | Kline . |
| 2,323,962 | 7/1943 | Ames . |
| 2,483,279 | 9/1949 | Hamilton . |
| 2,671,297 | 3/1954 | Arms . |
| 2,870,582 | 1/1959 | Raske . |
| 3,232,011 | 2/1966 | Pineau . |
| 3,362,113 | 1/1968 | Feather . |
| 4,187,644 | 2/1980 | Fitzpatrick . |
| 4,209,951 | 7/1980 | Gillette . |
| 4,253,279 | 3/1981 | Althen . |
| 4,437,267 | 3/1984 | Corley . |
| 4,455,789 | 6/1984 | Gehring . |
| 4,471,576 | 9/1984 | Corley . |
| 4,524,549 | 6/1985 | Sunnen et al. . |
| 4,897,968 | 2/1990 | Hutt . |
| 5,022,196 | 6/1991 | Schimweg et al. . |
| 5,085,014 | 2/1992 | Sandhof . |
| 5,185,969 | 2/1993 | Vanderwal, Jr. . |
| 5,255,476 | 10/1993 | Rutter . |
| 5,351,447 | 10/1994 | Grauert . |
| 5,371,978 | 12/1994 | Higashikawa . |

*Primary Examiner*—Eileen P. Morgan
*Attorney, Agent, or Firm*—Dinsmore & Shohl LLP

[57] ABSTRACT

An improved honing method and device connected to a source of pressurized fluid for machining a wall of a bore hole or similar interior of a workpiece. The honing device includes a tool mandrel connected in a cantilevered arrangement to a machine for rotating machining operations. A rigid honing member is secured to the tool mandrel, and configured such that the effective diameter of the substantially rigid abrasive outer surface of the honing member can be uniformly and precisely varied in a radial direction relative to the longitudinal axis of the tool in response to pressure on the interior surface of the honing member. A fluid distribution system formed in the tool mandrel in a predetermined arrangement is in fluid communication with the source of pressurized fluid, and includes a pressure chamber that is configured to apply fluid pressure to the interior surface of the honing member. At least one passage extends through the honing member from the pressure chamber and has an opening on the exterior surface of the honing member for delivering fluid to dissipate heat energy and remove debris.

20 Claims, 6 Drawing Sheets

FLUID-ACTIVATED VARIABLE HONING TOOLS AND METHOD OF USING THE SAME

TECHNICAL FIELD OF THE INVENTION

The present invention relates generally to honing tools and methods for machining of workpieces, and, more particularly, to a variable, fluid-activated quick-change honing tool for finishing workpieces wherein a substantially rigid honing member can be automatically and uniformly expanded to a predetermined, desired, effective machining diameter in response to fluid pressure.

BACKGROUND OF THE INVENTION

It is common practice in the machine tool industry to use honing tools for finishing the walls (e.g., removing about 0.001 to 0.005 inches of material) of a previously provided bore hole or similar interior surfaces of a workpiece. Honing operations generally correct inaccuracies in straightness and roundness in bore holes, can provide a uniform plateau surface, can remove burrs or finish surfaces knurled, or can also provide a desired cross-hatch angle in the finish of the interior machined areas of a workpiece.

In the past, honing tools have generally been constructed with a plurality of symmetrically arranged work engaging assemblies having abrasives (e.g., rigid stones), which are mounted in slots on a tool body for movement radially. Mechanical activation assemblies, such as springs, pusher rods, rack and pinion arrangements, tapers or cam devices, urge the work engaging assemblies, and advance the abrasives to a working position for engagement with a work surface. Also, these assemblies can assist in retracting the work surfaces from the working positions so that the honing tool can be more easily removed from the interior of a workpiece. The nature of these assemblies for advancing the abrasives requires frictional engagement between the activation assembly and work engaging assembly, and thus, mechanical friction is generated at the interface. Over time, mechanical friction being continuously and repeatedly generated at this interface alters the inter-workings of these mechanical assemblies due to use (e.g., wear and tear), and thus, compromises the accuracy of the tool. Chips from the workpiece can also become lodged in the slots where the work engaging assemblies move radially outwardly from the tool, and can even become lodged between the interface of the activation assembly and the work engaging assembly while the work engaging assemblies are radially moved to their working position, thereby interfering with the operations of the tool. Such interference with the operations of the tool can inhibit uniform radial expansion of the abrasive, which can also compromise and diminish the honing accuracy, and can cause excessive wear and tear on portions of the abrasive as a result of the work load being unevenly distributed. Moreover, the work engaging assemblies can even become fixed in the working position making removal of the honing tool from the workpiece more difficult.

Some prior honing tools, such as illustrated U.S. Pat. No. 2,284,134 to Conner, mount a plurality of stone disposed in slots in an abrading head such that a balanced pressure urges the stones to move radially into a working position. Pistons or other fluid-activated means are used to move the stones outwardly. Since the tool contemplates that the stones move away from the slots, recently cut chips can become lodged where the stones are moved radially from the abrading head to their working positions, and thus, can interfere with the operations of the tool.

Other prior honing tools have used a sleeve-shaped configuration with one or more slots extending through the sleeve. The slots serve several important and necessary functions in the operation of these honing tools. First, they can provide a key way for guiding the mechanical activation assemblies, as discussed above, so that the activation assembly remains properly aligned as it advances in the desired direction. Secondly, the slots open outwardly to enable radial expansion when acted upon by the various mechanical activation assemblies or fluid pressure. Third, the slots, in conjunction with a key on a tool mandrel, can provide a key and slot arrangement for preventing rotation of the sleeve relative to the tool mandrel during use.

Other previously available honing tools use suitable fluid pressure as the activation assembly for expanding flaps provided in an outer surface of a cylinder. For example, in U.S. Pat. No. 3,362,113 to Feather, a piece of emery cloth or other flexible abrasive material is wrapped around and secured to a cylinder, and, as the fluid pressure increases in a rubber tube disposed in the cylinder, the fluid pressure expands the flaps, thus, increasing the force between the abrasive surface and the inside surface of a bore hole. If fluid pressure is not properly controlled and rises above a critical level, the very nature of these assemblies allows for continued expansion of the sleeve as the workpiece is worked. Since the ability to control radial expansion of the tool is hampered, tool accuracy is compromised, and predicting or controlling the radial expansion corresponding to fluid pressure can be difficult and cumbersome.

Another honing tool, for example as seen in U.S. Pat. No. 5,085,014 to Sandhoff, has honing rings mounted along the axial surface of a tool body in annular grooves, and includes an abrasive layer on the outer periphery. An inner bore is provided within the tool body that is adapted to supply coolant from a source to the interior surface of the honing rings for moving the rings into engagement with the bore surface. However, the rings do not uniformly expand in the radial direction. Instead, the rings expand as though uncoiling, whereby certain portions often expand further in the radial direction than other portions, such as those portions where the rings are secured to the tool body. The resulting, non-uniform expansion of the tool wears much more on certain areas of the abrasive (i.e., where radial expansion is greater) than on other areas. As tools are repeatedly used, accuracy and reliability of the honing tool is compromised and the abrasives must often be replaced prematurely.

In almost all machine tool operations, including honing, the friction between the tool and workpiece generates tremendous amounts of heat energy, which can reach temperatures of 2000° F. (1100° C.) and above. If left uncontrolled, such heat could severely damage (e.g., cracking or fracturing) the tool, thus reducing its tool life, making machine tool operations more dangerous and expensive, and reducing the quality and precision of the workmanship. In addition, heat generated friction can discolor the workpiece, and can damage or remove temper or heat treatments. It is commonly known in the industry that coolant can be introduced to the machining area, such as by spraying, to reduce friction between the tool and workpiece by maintaining a thin film of coolant fluid between the cutting tool and the workpiece, and to help remove heat energy generated in machine tool operations.

Although coolant fluid can be supplied to the honing area, it is often difficult to insure that such fluid actually makes its way to the interstices between the tool and all of the workpiece surfaces being machined. Additionally, fluid tends to evaporate quickly due to the high temperatures involved in honing operations. Thus, larger volumes of coolant fluid must generally be continuously supplied to the honing area for the honing tool to operate effectively. This need to keep a thin continuous film of coolant fluid between the honing tool and wall of the bore hole becomes even more problematic in operations where coolant fluids cannot be introduced in close proximity to the honing areas while the honing tool is engaged with the interior surface of the workpiece.

During use, the work engaging surface of the tool can also become loaded with particles or recently cut chips from the interior surface of the workpiece, which in turn, reduces the accuracy and effectiveness of the tool through deteriorating honing ability, and/or clogging of conventional coolant fluid supply openings. It is obviously preferred that the potential for this undesired loading of particles be reduced, and that any loaded particles be removed from the honing tool as quickly as possible. Typically, nozzle arrangements, such as an external cleaning jet, are provided independent of the tool, for injecting coolant fluid at increased velocities toward the work engaging surface and the work surfaces of the workpiece to wash away particles, to remove particles already loaded on the work surface, and to cool the honing tool and the workpeice. As mentioned before, it is often very difficult to insure that the fluid sprayed in this way actually reaches the most critical areas of the tool/workpiece interface.

Other attempts to deliver coolant fluid to the honing area have included air or other pneumatic carriers. As with externally applied liquid coolants, when pneumatic carriers are used, resulting turbulence can hinder the honing operations, and often fluid cannot infiltrate into the actual honing area. Previously, attempts to address these two requirements of cooling and cleaning the honing tool and workpiece have tended to reduce the accuracy and utility of the tool.

As can be seen, currently available honing tools have a number of shortcomings that can greatly reduce the accuracy of the tools, the tool's life, and its ability to use these tools with automatic tool changing systems. The current structures and assemblies provide a honing tool having working surfaces that can continue to expand with continued use of the tool, whereby control and predictability of the tool's expansion is compromised. Moreover, the work engaging assemblies of these prior honing tools do not always move uniformly in a radial direction when activated. Non-uniform movement of the assemblies results in uneven application of the abrasive, and reduces the assembly's usable life. Furthermore, other prior honing tools have working surfaces that move radially outwardly from a slot. Chips from the workpiece can become lodged in these slots when the working surfaces have been moved to the working position, which can hamper the operations of the tool. A need currently exists in the machinery industry for a honing tool with a substantially rigid work engaging assembly having accurately controlled machining diameters so that the tool cannot become oversized a result of excessive strokes of the tools, and the ability to uniformly and selectively expand in a radial direction. As such, control and predictability of expansion is maximized and tool life is enhanced.

Honing tools will generally be operated at higher rotational speeds, which result in increased temperatures being generated on the workpiece and the tool. A tool operating under these conditions generally requires additional external coolant fluid supplies or jets to reduce or remove loaded particles from the honing tool and/or to cool the workpiece and honing tool. The industry currently lacks a honing tool configured to allow for use of the tool in honing operations which utilizes through spindle coolant to actuate the honing member, and can be used in a quick change machine tool center while also allowing for efficient and accurate honing.

SUMMARY OF THE INVENTION

It is an object of the present invention to provide a honing tool that addresses and overcomes the above-mentioned problems and shortcoming in the machine tool industry.

It is a further object of the present invention to provide an improved performance honing tool that has an increased tool life.

It is also an object of the present invention to provide a honing tool that eliminates the need for external coolant fluid jets for cleaning or removing loaded particles from the tool's grinding surface during use, and routes fluid in close proximity to the work engaging surface to wash away recently cut particles.

It is yet another object of the present invention to provide an improved performance honing tool where the workload is reliably distributed over substantially the entire work engaging surface.

It is another object of the present invention to provide an improved performance honing tool for accurately and uniformly honing a workpiece.

It is further an object of the present invention to provide an improved performance honing tool that can be selectively adjusted during machine operations for multi-stroke applications.

It is another object of the present invention to provide an improved honing tool for use in providing desired range of cross-hatch angles in the working surfaces of a workpiece.

It is still another object of the present invention to provide an improved performance honing tool in which coolant fluid delivery to the working area is not inhibited while the honing tool is engaged with a surface of the workpiece.

It is an object of the present invention to provide an improved performance honing tool that is easy to remove from a tool mandrel.

It is yet an object of the present invention to provide an improved performance honing tool that can be used with a quick change or automatic changeable tool system having a fluid pressure source.

It is a further object of the present invention to provide an improved performance honing tool that continuously, selectively, and controllably delivers coolant fluid to the machining area despite the type of tool engagement.

Yet another object of the present invention is to provide an improved performance honing tool which self regulates itself for wear and tear on the abrasive.

Still a further object of the present invention is to provide an improved performance honing device where the work engaging surface can be uniformly varied in a radial direction by selectively applying fluid pressure.

A further object of the present invention is to provide an improved performance honing tool that dissipates thermal energy generated in the machining operations, and reduces thermal expansion of the honing member.

Additional objects, advantages and other features of the invention will be set forth and will become apparent to those skilled in the art upon examination of the following, or may be learned with practice of the invention.

To achieve the foregoing and other objects, and in accordance with purpose herein, the present invention comprises an improved honing device connected to a source of pressurized fluid for machining workpieces, and particularly, interior surfaces such as bore holes. The improved honing device includes a tool mandrel connected in a cantilevered arrangement to a machine for rotating machining (e.g., honing) operations. A substantially rigid honing member is secured to the tool mandrel, preferably slidably receivable around the tool mandrel and frictionally held in place, and configured such that the exterior surface of the honing member can be selectively and substantially uniformly expanded in a radial direction relative to the longitudinal axis of the tool in response to fluid pressure on the interior surface of the honing member. An abrasive is provided on at least a portion of the exterior surface of the honing member for honing the wall of a workpiece in use. A fluid distribution system is formed in the tool mandrel in a predetermined arrangement and is in fluid communication with the source of pressurized fluid. The fluid distribution system also includes a pressure chamber so that fluid pressure can be applied to the interior surface of the honing member. At least one passage extends from the recess and through the honing member, and has an opening on the exterior surface of the honing member for fluid to exit so that it can dissipate thermal energy and remove recently cut chips or other particles or debris.

The honing device can further include an assembly structure, such as an end cap, affixed at the distal end of the tool mandrel for further maintaining the longitudinal position of the honing member on the tool mandrel.

The honing device of the present invention can be used with a machining station that includes a machine spindle for rotating machining operations, an engagement device for securing the tool in a cantilevered arrangement, a workpiece to be machined by the tool, a source of pressurized fluid, and an arrangement for moving the workpiece relative to the spindle. The tool mandrel has a tool holder disposed at its proximal end adapted and configured for quickly attaching the honing tool to the spindle. The machining station also includes a connector for automatically and quickly placing the honing tool in fluid communication with the source of pressurized fluid without requiring separate fluid connections.

In use, the honing tool moves relative to the workpiece and is preferably positioned in a preexisting bore hole or other interior surface to be worked. The tool begins to rotate and reciprocate (e.g., move axially back and forth) while in the interior surface. While the tool is rotating and reciprocating, the fluid pressure in the fluid delivery system is altered (e.g., increased) as desired, either gradually over time or substantially instantaneously. A build up of fluid pressure in the pressure chamber uniformly expands the exterior surface of the honing member in a radial direction, whereby the work engaging surface portion engages the interior surface and finishes it as the tool continues to reciprocate and rotate. After the honing operation is completed, the pressure in the fluid delivery system is decreased, whereby the honing sleeve returns to its original position, and the tool is removed from the workpiece.

BRIEF DESCRIPTION OF THE DRAWINGS

While the specification concludes with claims particularly pointing and distinctly claiming the present invention, it is believed the same will be better understood from the following description taken in conjunction with the accompanying drawings in which:

DETAILED DESCRIPTION OF THE PREFERRED EMBODIMENTS

Figure 1:
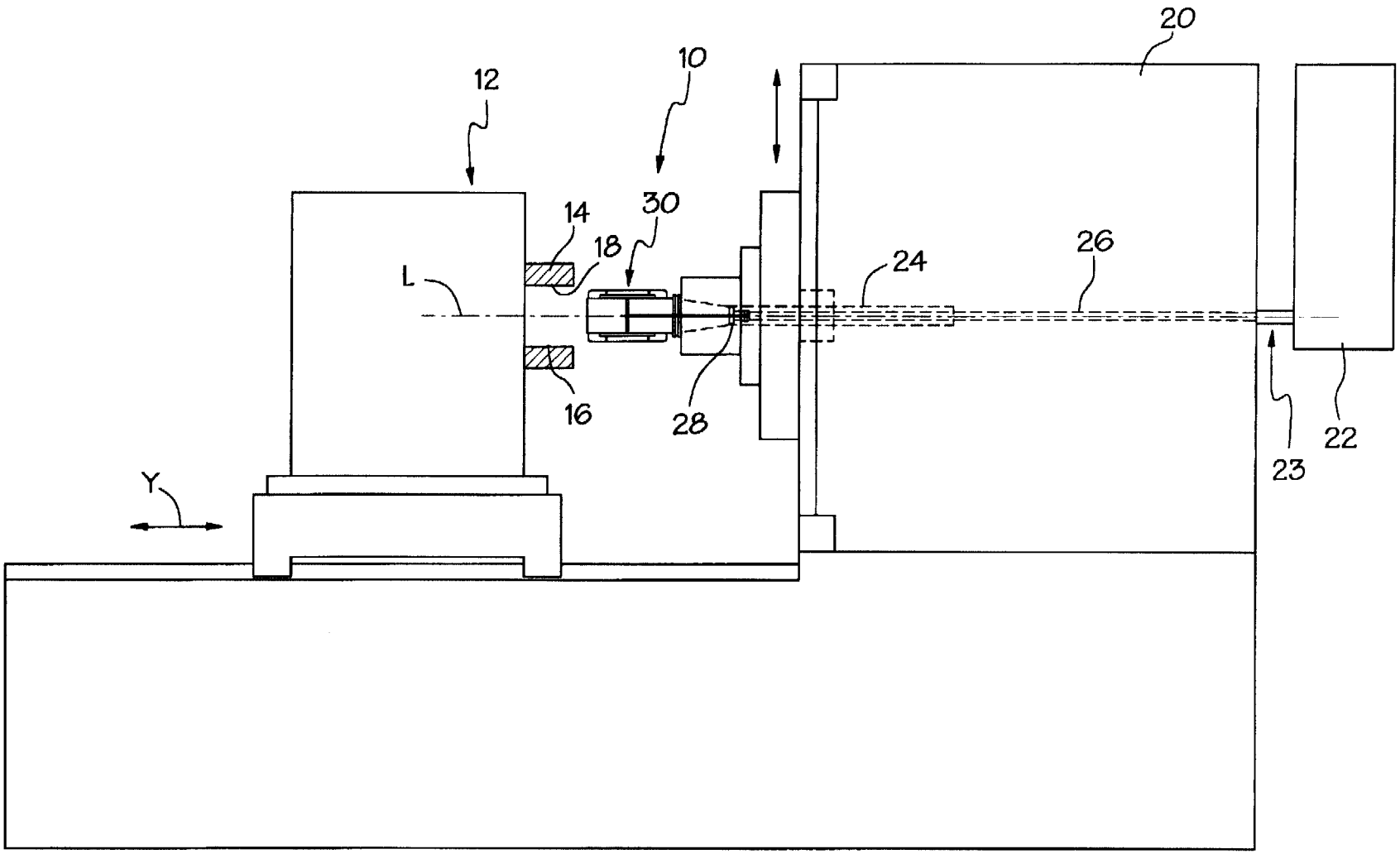
FIG. 1 is a schematic elevational view of a machine spindle showing through-spindle fluid communication between a fluid supply and a preferred honing device of the present invention arranged for quick change use in a machine center environment.

Referring now to the drawing figures in detail, wherein like numerals indicate the same elements throughout the views, FIG. 1 illustrates working area 10 which typically comprises a machining station 20 and a work head 12 having a workpiece 14 attached thereto using fixtures and techniques known in the industry. Workpiece 14 is illustrated as a single exemplary structure having a bore hole or similar hollow interior portion which requires honing or finishing. In operation, the tool 30 and workpiece 14 are generally rotated or moved respectively to each other as tool 30 is brought into contact with the workpiece 14 (see arrow "Y") in order to enable machining operations such as honing.

The present invention is preferably adapted for use with an machining station or center 20 having a machine spindle 24 which can be rotated at varying speeds by a power source (not shown), and which can quickly and easily receive and secure one of a plurality of tools for various operations (i.e., rotating, vibrating or oscillating). A machining station 20 typically has a synchronized system, such as an automatic tool changer (not shown), for quickly and easily interchanging and utilizing multiple matching tools at one machining station or center 20, thereby allowing machining station 20 to provide greater utility or range of operations, (i.e., they are not dedicated to a single operation or use of a single type of tool).

Any assembly for engaging (e.g., 25) (i.e., clamping or otherwise securing) the proximal end of the tool 30 in a generally cantilevered fashion with the machine spindle 24, such as a drawbar, a collet, a mandrel device, or other device known in the industry, can be used, so long as fluid can be provided to the tool 30 adjacent the spindle/tool interface 28 while the tool 30 is in use. A preferred engaging assembly 25 allows for quick interchange of tools and provision of fluid communication between the spindle passage 26 and the fluid distribution passageway 40 at tool/spindle interface 28 without the need for separately hooking up hydraulic lines or other fluid connections. As will be understood, the tool 30 could also be utilized in conventional applications and dedicated operations as well.

Figure 2:
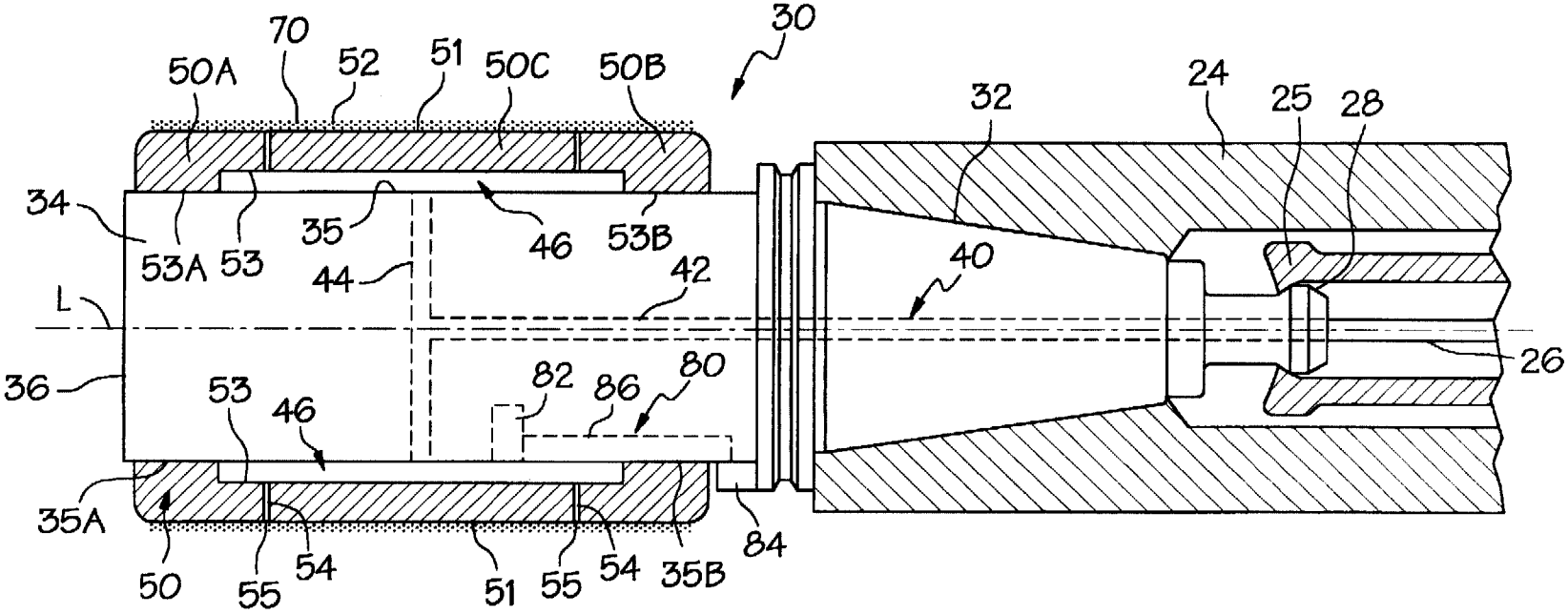
FIG. 2 is a vertical sectional view of a honing device made in accordance with the present invention and illustrating a preferred arrangement of a tool holder and the honing device.

Referring now to FIG. 2, the honing tool 30 preferably includes a tool holder 32 adapted for use with a machining station 20, a generally cylindrical shaped, elongated tool mandrel 34, and a honing member 50 that is preferably slidably receivable around the outer or peripheral surface 35 of tool mandrel 34. Tool 30 is also illustrated as having a longitudinal axis, as denoted by "L".

The tool mandrel 34 preferably comprises a body having a peripheral surface 35, and is made of a rigid material (e.g., heat treated steel or the like) configured in a longitudinally extended generally cylindrical shape. The tool mandrel 34 can be of any desired length, however, it is preferably sufficiently long to receive the entire length of the honing member 50. A variety of standard materials available in the industry can be used to form the tool mandrel 34, so that it is sufficiently rigid and maintains its structural integrity in the desired form during the honing operations at rotational speed from about 200 to about 20,000 revolutions per minute and so that adverse material deformation does not occur as fluid pressure in the fluid distribution system 40 increases to levels from about 200 pounds per square inch ("psi") to about 1,000 psi ($1.38\times10^6$ n/m$^2$ to $6.89\times10^6$ n/m$^2$). Illustrative examples of materials which might be used include aluminum, steel, or the like. For example, an aluminum alloy might be preferred where there is a need for a lighter weight tool, which might be preferred when the tool 30 is interchanged in a machine spindle 24 using an automatic tool changing system.

Preferably formed within the body of tool mandrel 34 is a supply tube 42, which is part of the fluid distribution system 40, extending along the longitudinal length of tool 30 in a predetermined arrangement. Both the tool 30 and the tube 32 are preferably oriented so that they share the same center longitudinal axis of rotation. As will be better understood from the description herein, this coaxial orientation of the tool 30 and the supply tube 42 is preferred so that the interchanging of tools made in accordance herewith (i.e., securing the tool 30 in place and establishing fluid communication between the spindle passage 26 and the fluid distribution system 40) can be accomplished quickly and automatically upon attachment of tool 30, and to preserve balance in the tool 30 so that eccentricities, which could cause vibrations during use, are held to a minimum. In this regard, off-centered routing of supply tube (supply tubes) 42 within the tool 30 could be employed, but in such cases, it would be preferred to make such tubes symmetrical with the tool mandrel 34 to preserve balance during high speed tool rotation.

Forming the fluid distribution system 40, including the supply tube 42, in the tool mandrel 34 and having fluid routed therethrough also provides an effective heat sink to dissipate thermal energy generated during machining operations, further minimizing undue thermal expansion. If the tool mandrel 34 were to undergo significant or uncontrolled thermal expansion, and particularly in a radial direction, the outer diameter of the tool mandrel 34 would increase, thus reducing the predetermined space or distance (i.e., the pressure chamber 46) between the peripheral surface 35 of the tool mandrel 34 and the inner face 53 of the honing member 50. As will be discussed in greater detail below, it is preferred that this distance remain relatively small (e.g., from about 1 mm to about 50 mm) and consistent while the honing member 50 remains unextended or undeflected by fluid pressure.

Figure 3:
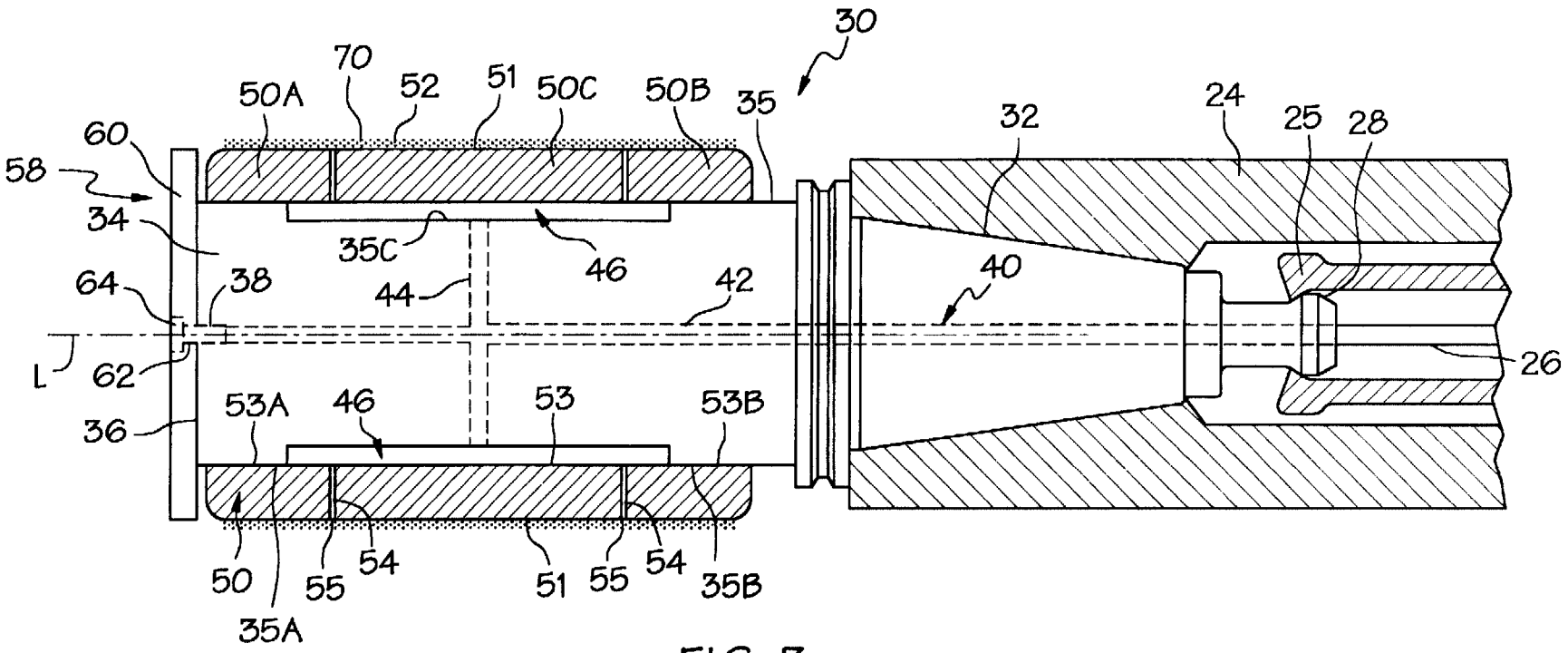
FIG. 3 is a vertical sectional view similar to FIG. 2 and showing an alternative embodiment of a honing device made in accordance with the present invention.

Referring back to FIG. 1, the work area 10 also includes a fluid supply system 23 that generally provides a source (22) of pressured fluid to be routed through the spindle 24 (via spindle passageway 26) and through tool 30 (via the fluid distribution system 40) to the outer surface 51 of the honing member 50 and (more preferably) the work engaging surface 52, as best seen in FIGS. 2 and 3. The fluid supply system 23, often referred to as a through-spindle coolant or fluid system, also generally includes a compressor or other system (not shown) for pumping fluid at the desired pressure and flow rate. The spindle passage 26 has a distal end which preferably automatically sealing interfaces with the tool 30 and fluid distribution system 40 at the tool/spindle interface 28. This seal might be provided in a variety of structural arrangements, including O-ring, seals and the like, and its exact structure may vary among particular applications.

Fluid communication is thereby automatically and immediately established and maintained between the spindle passageway 26 and fluid distribution passageway 40 when the honing tool 30 is engaged and held in place by the engaging assembly 25 using various assemblies and techniques known in the industry, as discussed previously. It should be noted that when the tool 30 is not engaged with the engaging assembly 25, mechanisms known in the industry (e.g., shut off valves or the like) can be used to terminate the flow of coolant fluid adjacent the end of the spindle passage 26.

Figure 4:
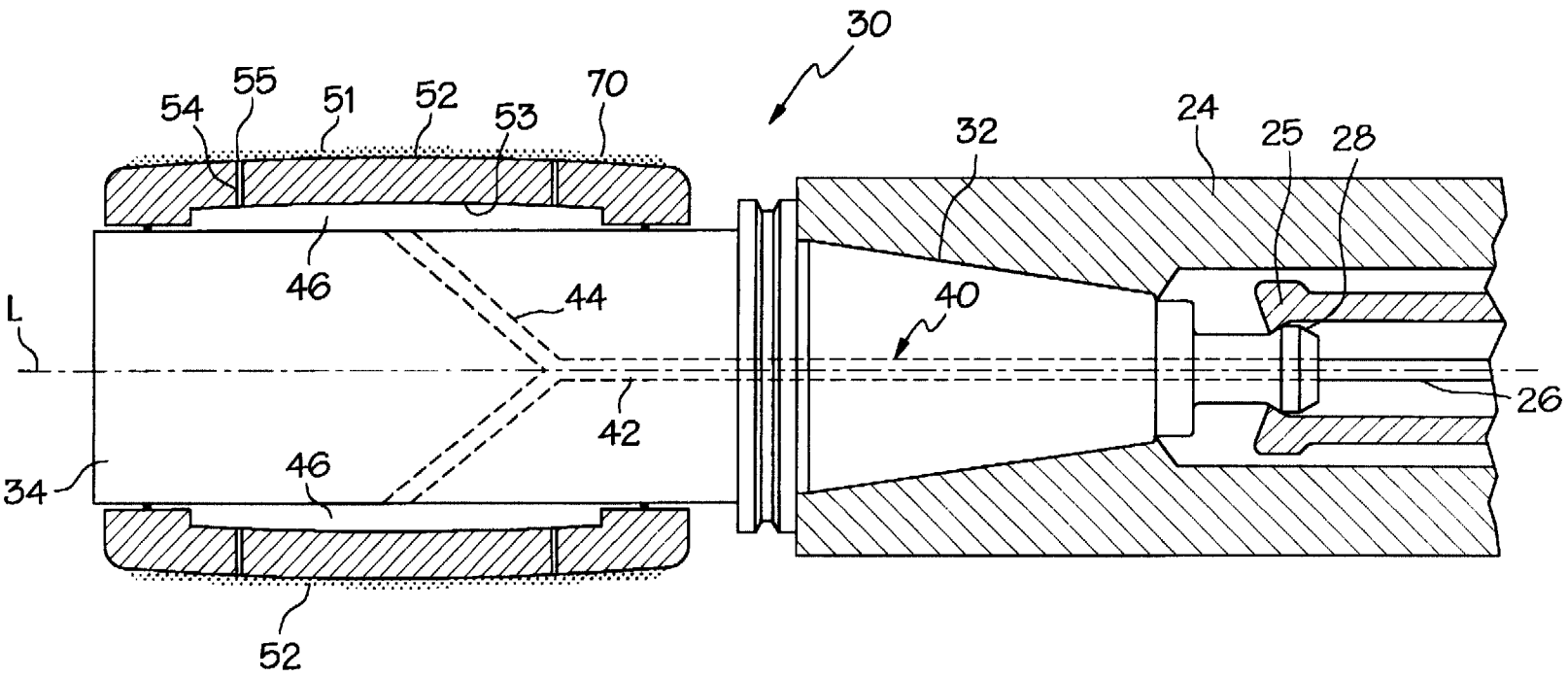
FIG. 4 is a vertical sectional view of yet another alternative embodiment of a honing device made in accordance with the present invention showing the honing device in a honing position.

Supply tube 42 is illustrated as splitting into a plurality of branch passages 44 in order to establish fluid communication between the supply tube 42 and the peripheral interior pressure chamber 46. Branch passages 44 are also preferably appropriately placed and oriented so that the tool 30 remains balanced during use. As shown best in FIGS. 2 and 3, branch passages 44 can be formed in the tool mandrel 34, such that they extend radially outwardly at an angle of about 90° relative to the longitudinal axis "L" of the tool mandrel 34, or so that they feature other advantages (e.g., upward and inward) orientations from the peripheral surface 35, as exemplified in FIG. 4. The number, location and size of branch passages 44 required to deliver an adequate volume of fluid through tool 30 to the pressure chamber 46 for selectively deflecting or extending the honing member 50 to the honing or deflected position (see FIG. 4) depends on a variety of variables, including the force (e.g., hydraulic pressure) required to deflect or extend the particularly selected honing member 50. Some of the fluid in the pressure chamber 46 can be preferably delivered ("or leaked") through the guide passages 54 and their respective corresponding pin hole openings 55, on the exterior surface 51 to remove shavings and particles from the exterior surface 51, including work engaging surface 52 and abrasives 70, and to help cool the tool 30 and the workpiece 14.

Although the actual dimensions of the tool 30 will vary depending on the particular application, in an exemplary embodiment where the honing tool 30 has a diameter of about 4.0 inches (10.17 cm), the central supply tube 42 might preferably have a diameter of from about 0.125 inches (0.32 cm) to about 0.75 inches (1.9 cm), and preferably about 0.37 inches (0.95 cm). Additionally, four (4) branch passages 44 might preferably be equally spaced (at about 90° angle intervals) around the tool 30, each having a diameter of from about 0.15 inches (0.38 cm) to about 0.25 inches (0.65 cm), and most preferably about 0.187 inches (0.47 cm).

FIG. 3 illustrates a preferred embodiment in which an assembly 59, such as an end cap 60, is affixed to the distal end of the tool mandrel 34 for restricting longitudinal movement of the honing member 50 while in use. The present invention contemplates using a variety of structures and/or configurations for restricting longitudinal movement, and the exact assembly may vary depending on the desired application. It is preferred, however, that the selected assembly (e.g., 59) be easily removable so that the honing member 50 can be quickly removed and replaced, or interchanged if necessary, and that the selected assembly not interfere with honing operations.

In a preferred embodiment incorporating an end cap 60, a recess 38 is provided in the bottom face 36 of tool mandrel 34, that is sized and configured to receive a fastener 64, such as a pin, screw, or bolt, which fits through a hole 62 to secure the end cap 60 to the tool mandrel 34. Additionally, the fastener 64 can also serve effectively to plug or reroute fluid adjacent the distal end of supply tube 42. Alternatively, a plugging device (not shown), separate from the fastener 64, can be used independent of, or in conjunction with, the fastener 64 to effectively plug the distal end of the supply tube 42 within tool 30.

The present invention features a substantially rigid honing member 50 that is preferably a substantially cylindrical sleeve-shaped. The honing member 50 is typically a resilient, self-supporting structure having an interior surface 53 that is slidably receivable around the peripheral surface 35 of the tool mandrel 34 so that the pressure chamber 46 is interposed therebetween. The outer surface 51 of the honing member 50 is preferably substantially rigid, and, typically has been surface-hardened and/or coated for abrasion or wear resistance so that the honing member 50 could be used with dry or intermittent fluid delivery, and so that abrasions on the outer surface 51, which might be caused by debris and recently cut particles, can be minimized.

The honing member 50 can be a separate unitary structure from the tool mandrel 34, and can be formed in a variety of ways, such as by investment casting or machining a billet to achieve the desired general tubular configuration and shape. As a unitary structure, upon selective activation by increased fluid pressure in the pressure chamber 46, the honing member 50 can be deflected or extended radially outwardly in a uniform manner to the honing position (see FIG. 4). Since the honing member 50 has no moving parts, it can provide an effectively uninterrupted work engaging surface 52. Alternatively, it can be formed as several pieces and connected using techniques and assemblies, such as a tongue and groove assembly, known in the industry. Illustrative examples of materials which might be employed as the honing member 50 include steel, medium carbon steel, aluminum, cast iron, titanium, or other metal alloys. It is important to note that the dimensions (e.g., thickness), material selected, and surface treatment for the honing member 50 in the present invention be selected such that the internal resistance of the honing member 50 provides sufficient and substantial rigidity so that the honing member 50 is self-supporting (i.e., it maintains its own shape when unsupported), so that expansion of the honing member 50 is controllable, and substantially uniform in a radial direction in response to increased fluid pressure, and so that at least some of the fluid can be directed or leaked through the passages 55 to openings 55 on the exterior surface 51. As mentioned above, preferred embodiments of the honing member 50 have a thickness from about 1 mm to about 10 mm, and preferably about 2 mm.

The honing member 50 is preferably telescopingly receivable on and around at least a portion of the peripheral surface 35 of tool mandrel 34, and is preferably coupled and secured to the peripheral surface 35. Portions 53A and 53B of the interior surface 53 are fluid-sealable coupled to the peripheral surface 35, whereby a pressure chamber 46 is interposed therebetween.

One embodiment of the present invention contemplates that the honing member 50 be heat shrunk onto the tool mandrel 34. Heating the honing member 50 from an ambient temperature to an increased temperature causes radial expansion of the honing member 50, and its interior surface 53 can then preferably be slidably fitted around the tool mandrel 34. As the honing member 50 returns to the ambient temperature, it radially decreases in size, and engagement portions 53A and 53B of the interior surface 53 are thereby interference-fitted onto the peripheral surface 35 of the tool mandrel 34, whereby a predetermined tight frictional engagement of the peripheral surface 55 and the inner surface 53 substantially prevents longitudinal and rotational movement of the honing member 50 relative to the tool mandrel 34. Alternatively, honing member 50 might be press-fitted onto tool mandrel 34, with or without heating, and/or adhesives can be utilized as appropriate.

Other possible connector techniques and assemblies that can be used with the present invention for securing or coupling the honing member 50 onto the tool mandrel 34 include spot welding the tool mandrel 34 and honing member 50 together; providing a mating threaded arrangement on a portion of the peripheral surface 35 of the tool mandrel 34 and the interior surface 53 of the honing member 50; inserting bolts, pins or screws through the honing member 50 and into the tool mandrel 34; or positioning and tightening clamps around the outer surface 51 of the honing member 50 at the proximal and distal portions. Whatever securement techniques or assemblies are used with the present invention, undesired fluid leakage from the pressure chamber 46 should be minimized so that the honing member 50 can be deflected or extended by increased fluid pressure in the pressure chamber 46, and so that the honing member 50 can be removed easily from the tool mandrel 34 when desired for maintenance and/or replacement. It is also contemplated that the tool mandrel 34 and honing member 50 could be integrally formed or permanently attached, although such would generally be less preferred.

The present invention also contemplates that a plurality of guide channels 54 can preferably be formed or bored completely through the honing member 50, with each having an opening 55 on the outer surface 51 in close proximity to the work engaging surface 52. Guide channels 54 are sized and configured so that a sufficient amount of fluid is directed from the pressure chamber 46 into in close proximity with the work engaging surface 52 for preferably washing away recently cut or ground particles, and for helping to dissipate heat energy generated in machining operations.

As can be appreciated, increasing the diameter of guide channels 54 and openings 55 reduces flow resistance, which in turn increases the flow volume. However, such a structural change can result in excessive fluid outflow from the pressure chamber 46, which can result in a decrease of the fluid pressure and/or sensitivity in the pressure chamber 46, unless fluid is quickly and constantly replenished via the fluid distribution system 40. Also, increasing the diameter of the guide channels 54 results in a decrease in fluid velocity therethrough, which can reduce the efficiency and effectiveness of the cleaning (i.e., washing away cut and/or plated particles) of the work engaging surface 52 and the interior surface 18 the workpiece 14. As with other portions of the fluid delivery system 40, the guide channels 54 are appropriately positioned and oriented, preferably substantially perpendicularly to the outer surface 51 of the honing member 50, so that the tool 30 remains balanced during use. Perpendicular orientation allows for direct impingement of the worked surface (e.g., 18) of a workpiece, although other angles of channels 54 can also be advantageously utilized as well.

The space or clearance between the peripheral surface 35 of the tool mandrel 34 and the interior surface 53 of the honing member 50 preferably defines the pressure chamber 46, which can be sized and configured to accumulate fluid therein, and to apply sufficient, uniform fluid pressure against the interior surface 53 of the honing member 50. Fluid is preferably routed from the fluid supply 22, through the fluid distribution system 40 and to pressure chamber 46. Pressure chamber 46 (i.e., honing member 50 and the peripheral surface 35) should be configured and designed to provide sufficient resistance to, and restrict, the flow of fluid, and be substantially fluidly-sealed, except for any desired guide channels 54, in order to control the rate of fluid leakage so that fluid pressure levels within the pressure chamber 46 can be maintained at levels necessary to alter the effective honing diameter (e.g., $D_1$ and $D_2$) of the substantially rigid honing member 50 (e.g., from about 200 psi to about 1000 psi) or ($1.38\times10^6$ n/m$^2$ to $6.89\times10^6$ n/m$^2$) without requiring undesirable or excessive volumes or pressures of fluid.

The pressure chamber 46 can also advantageously serve as a heat sink when filled with fluid, such that the fluid helps to dissipate the heat energy from the honing member 50, which, in turn, further minimizes thermal expansion of the honing member 50. If the honing member 50 were to undergo significant or uncontrolled thermal expansion, and particularly in a radial direction, the effective outer diameter of the honing member 50 would similarly increase, thus reducing the distance or space between the outer surface 51 of the honing member and the interior surface 18 of the workpiece 14, when the honing member 50 is undeflected (e.g., $D_1$). Thermal expansion of the honing member 50 could result in portions of the outer surface 51 prematurely contacting the workpiece, or otherwise causing wear and tear on outer surface 51, and ultimately, could adversely affect the accuracy and reliability of the tool 30 in subsequent honing operations.

FIG. 2 illustrates an embodiment of the present invention where the pressure chamber 46 is defined by two thicker annular shaped portions, 50A and 50B, respectively of honing member 50, that are configured as inwardly extending lands disposed near the distal and proximal portions of the honing member 50 on either end of a recess or pad defined by inner surface 53.

FIG. 3 illustrates an alternative preferred embodiment of the present invention where the pressure chamber 46 is defined by sliding a substantially sleeve-shaped honing member 50 around a tool mandrel 34 that has a peripheral surface 35 having a recess defined by surface 35C. In this embodiment, the outer diameter of the mandrel 34 is decreased, preferably, in a step fashion, along the center portion 35C between the proximal and distal portions, 35B and 35A, preferably about 1 mm to about 10 mm, whereby essentially, raised lands are provided to partially define the structure of the pressure chamber 46 once honing member 50 is secured thereover. Again, the interior surfaces 53A and 53B are press-fitted or interference-fitted onto the corresponding portions 35A and 35B of the peripheral surface 35, as mentioned above.

In yet another embodiment of the present invention not illustrated, the pressure chamber 46 might be provided by using the combination of a tool mandrel 34, illustrated in FIG. 3 (e.g., having a reduced diameter along the center portion 35A of the tool mandrel 34) with a honing member 50 as illustrated in FIG. 2 (e.g., having two thicker annular shaped distal and proximal portions 50A and 50B of the honing member 50 extending inwardly). For purposes of the present invention, the pressure chamber 46 can be provided by any structural so long as sufficient fluid pressure can accumulate therein to enable uniform, substantial, radial deflection of the honing member 50 to the effective or desired machining diameter (e.g., $D_2$).

Figure 5:
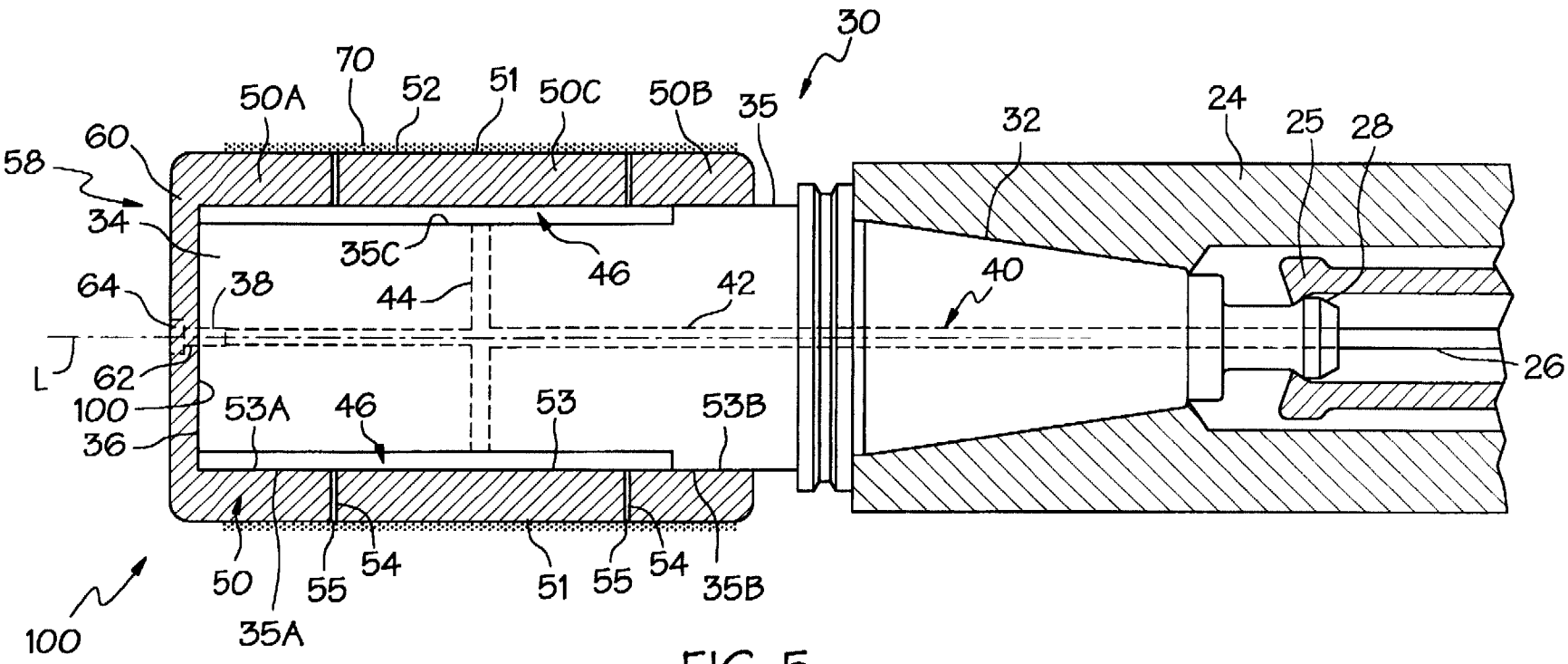
FIG. 5 is a vertical section view of another embodiment of the honing device made in accordance with the present invention showing the honing tool and assembly integrally formed.

In still another contemplated embodiment of the present invention, illustrated in FIG. 5, the honing member 50 and assembly 59 could be provided as a unitary structure 100. When using a unitary structure 100, annular portion 50A may not be required since the unitary structure 100, including the honing member 50, can be secured to the tool 30 using a fastener (e.g., 64), as discussed above, and since the interior axial surface 100A of the unitary structure provides a land to define the pressure chamber 46. By removing the annular portion 50A, as depicted, the pressure chamber 46 can thereby can be provided, and extended longitudinally along a greater portion of the peripheral surface 35 and the corresponding interior surface 53 of the honing member 50, which can result in an effectively enlarged work engaging surface 52.

The work engaging surface 52 comprises one or more layers of wear resistant abrasives 70 that can be applied to, embedded in, formed on, or plated on a portion of the outer surface 51 of the honing member 50. Abrasives 70 which are usable on the outer surface 51 in honing operations include those that are preferably able to provide a uniform plateau texture over the entire surface. More preferably, the abrasives 70 used with the present invention should provide the cross-hatch angles to face finish the bore hole 16 whereby the interior surface 18 has a certain degree of roughness to insure a stable lubricating film in the bore hole, yet also allows for favorable sliding behavior of an element, such as a valve stem. Honing operations in the present invention can be conducted at rotational speeds varying from about 350 revolutions per minute.

Illustrative examples of materials which might be used as abrasives include natural diamonds, synthetic materials including polycrystaline diamonds (PCD), manocrystaline diamonds (MCD), cubic boron nitride (CBN), or combinations of these materials. These types of abrasives are used to hone materials such as gray cast iron. In an alternative embodiment, a thin sheet, such as emery cloth is placed on or around the outer surface 51 or a substantially rigid honing member (e.g., 50).

Referring back to FIG. 1, in use, fluid is directed under pressure from a fluid supply 22 (e.g., from about 200 psi ($1.38\times10^6$ n/m$^2$) to about 250 psi ($1.72\times10^6$ n/m$^2$) and extending upwards to pressures in excess of about 1000 psi ($6.89\times10^6$ n/m$^2$). Preferably liquid fluids, such as any type of coolant/cutting fluids, are used with the present invention. For example, water-based coolants from about 5% to about 10% emulsified oils (i.e., lower oil content coolants) can be used. If fluid pressures in the fluid supply 22, spindle passage 26 or fluid distribution system 40 reach 250 psi ($1.72\times10^6$ n/m$^2$) or above, emulsified oils can become unstable, and therefore, are not preferred. At high pressure, pure coolant fluid oils are preferably utilized as the fluids, as it is known in the industry that pure coolant fluid oils are also often preferred for providing a better finish on a workpiece.

In yet another alternative embodiment, also shown in FIG. 2, the present invention can be provided with a closed looped feedback control system 80 for altering the fluid pressure in the pressure chamber 46. For example, a feedback sensor 82 might be provided, preferably on the outer surface of the tool mandrel 34, for measuring the distance from the peripheral surface 35 of tool mandrel 34 to the interior surface 53 of the honing member 50, and for measuring the rotational speed of the tool 30. This collected information is then transmitted to a sensor information coupling 84, via an electronic transmission line 86, which then transmits the information, either optically or electronically, to an electronic control unit (not shown) in the machining center 20. This information is gathered and used to monitor and adjust, if necessary, the rotational speed of the tool 30 and the fluid pressure in the fluid distribution system 40, and more importantly, the pressure chamber 46. Using such a feedback system 80 for monitoring and controlling the deflection or extension of the honing member 50 permits for more precise and accurate honing of an interior surface, so that the straightness and roundness of the bore hole 16 are achieved.

Figure 6:
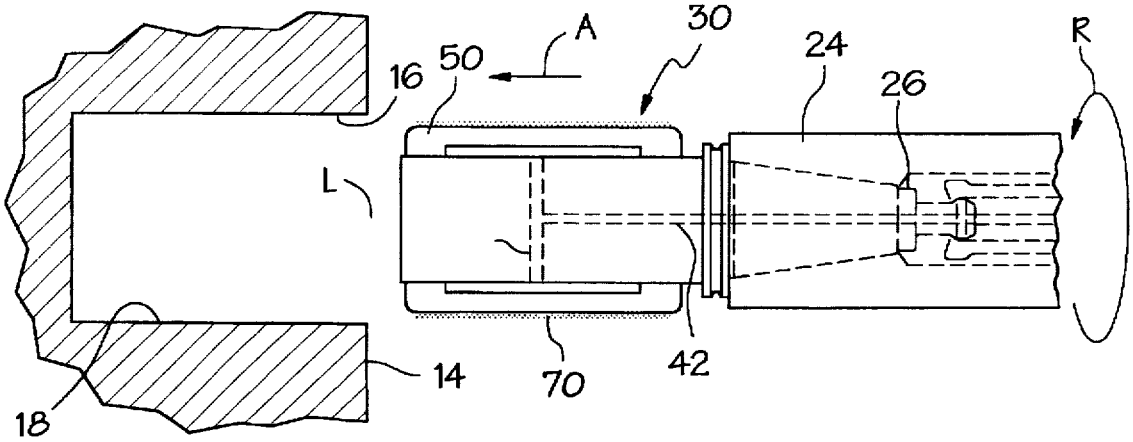
FIG. 6 is a vertical sectional view of the honing device of FIG. 2 before being inserted into the interior portions of a workpiece to be machined.

Referring now to FIGS. 1, 6–8, the present invention also includes a method for honing an interior surface 16 of a workpiece 14, such as gray cast iron. In use, the tool 30 can be used for honing interior surfaces 16, such as a bore hole, with a diameter slightly greater than the diameter of the outer surface 51 of the honing member 50 (see $D_1$ in FIG. 7). It is contemplated that the workpiece 14 will be mounted and secured to a workhead 12 using devices and techniques known in the industry, such as a draw bar or the like (e.g., 25), as previously mentioned. Once the tool 30 is properly positioned relative to the workpiece 14, as shown in FIG. 6, the tool 30 is moved relative to the workpiece 14, and is fed into a pre-existing hole or other interior space 16 in workpiece 14 in need of finishing or refinishing, such as honing a rough cut bore hole 16 in an internal combustion engine.

Figure 7:
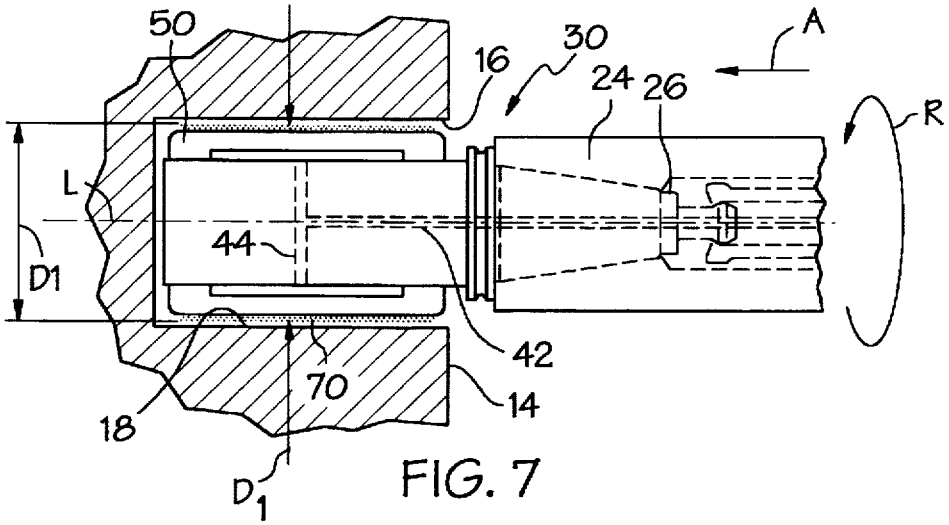
FIG. 7 is a vertical sectional view of the honing device of FIG. 5 after being inserted into a workpiece and before being expanded to its honing position.

FIG. 7 illustrate the spindle 24 rotating the tool 30 around the longitudinal axis "L" (see arrow R) at a select speed and moving axially back and forth (i.e., a reciprocating motion) (see arrow X) within the hole 16. While the tool 30 is rotating at a selected, constant speed and reciprocating, additional fluid from the fluid supply 22 is directed into and routed through the spindle passage 26, the supply tube 42, the branch supply passages 44, and into the pressure chamber 46. In the present invention, pressurized fluid should be continually supplied to the pressure chamber 46 to maintain the desired fluid pressure, as controlled leakage or evacuation occurs, preferably, through the pin hole openings 55 of the guide channels 54.

It will be appreciated that due to the substantially rigid honing member, the dynamics of the fluid flowing radially outwardly through the rotating tool 30, and the energy required to change the velocity of the fluid (e.g., accelerations and decelerations), a stiffer honing tool is provided with the present invention. For example, when an increased load is applied at a specific radial position on the outer face 51 of the honing member 50, the fluid compensates for the load by supplying less fluid to the area of the pressure chamber 46 with the greater pressure level and, conversely, more fluid to the area with the under pressure. Furthermore, since the fluid and tool 30 are rotating together, fluid is supplied at a substantially more even flow rate around the tool mandrel 34, which provides a stiffer honing member 50.

In operation, fluid pressure in the fluid delivery system 40 can be incrementally increased over time during the honing operation (i.e., while the tool 30 is within the workpiece and is rotating and reciprocating). Alternatively, the fluid pressure in the fluid delivery system 40 can be increased to the desired level substantially instantaneously after honing operations commence. In either operation, fluid pressure in the pressure chamber 46 thereby uniformly and radially expands the honing member 50, preferably by several mils and the work engaging surface 52 expands toward the desired or effective machining diameter, and engages the interior surface 18 as the tool 30 rotates, and preferably, as the tool 30 rotates (see arrow "R") and reciprocates (see arrow "X") in synchronicity, and material is removed from the interior surface 18 as the honing member 50 continues to expand radially, the fluid pressure within the pressure chamber 46 will equalize the pressure being exerted on the honing member 50 by the interior surface 18 and insure that such radial expansion is substantially uniform.

Figure 8:
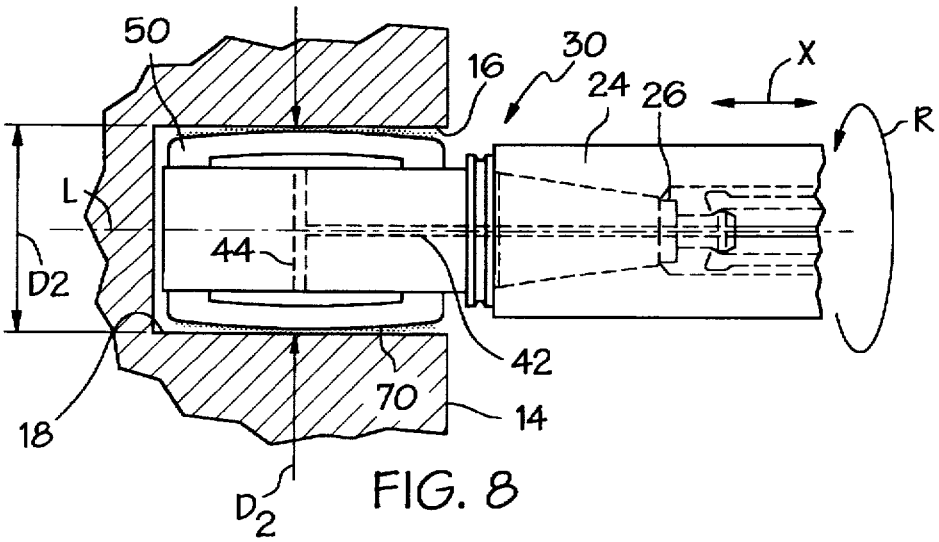
FIG. 8 is a vertical sectional view of the honing device of FIG. 6 after the honing member has been expanded into a honing position.

FIG. 8 illustrates the work engagement surface 52 being extended or deflected to a desired or effective machining diameter (e.g., $D_2$), and into frictional engagement with the interior surface 18, as the tool 30 continues to rapidly reciprocate (see arrow "X") across the desired portion of the interior surface 18 and rotate, (see arrow "R") in synchronicity. The expansion of honing member 50 from the non-deflected position (e.g., $D_1$) to the honing position (e.g., $D_2$) for about a 0.75 inch to about a 8 inch diameter tool 30 can vary from about 0.002 inches to about 0.02 inches (0.05 mm to 0.5 mm), and preferably is about 0.007 inches (0.18 mm). As the honing member 50 expands uniformly in the radial direction, the engaging portions 53A and 53B remain engaged with the peripheral surface 35, and are not deflected or extended. In fact, if these portions were to be significantly deflected or extended, fluid volume and fluid pressure would leak through gaps, and thus, fluid pressure would no longer exert sufficient pressure on the honing member 50 so that it remained expanded or deflected to the desired effective machining diameter.

Fluid flows or leaks into the guide channels 54 and exits through openings 55 to deliver fluid in close proximity to the work engaging surface 52. As mentioned before, fluid preferably impinges the workpiece 14 to assist in washing away recently cut particles and to help cool (i.e., dissipate heat energy) the workpiece 14 and tool 30.

In an alternative embodiment of the present invention, the fluid pressure can be adjusted during honing operations, either manually, or automatically in the response to the feedback control system 80. At such times, fluid pressure can be adjusted if protrusions, depressions or other irregularities exist in the interior surface 18. As the defect (if a protrusion type) is reduced or eliminated, the tool 30 turns more freely in the bore hole 16. For example, the work engaging surface 52 may be applied to the interior surface 18 with a relatively light pressure for an interval of time sufficient to remove major irregularities, whereby interior surface 18 is somewhat smoothed off so that resistance to the tool 30 is decreased. Accordingly, the next step is to finish the interior surface 18, and this operation may be carried out with increased tool pressure to enable the tool 30 to operate at maximum efficiency. In this operation, higher efficiency of the tool 30 is obtained without subjecting the tool 30 to undue strains and stresses.

The present invention can be used at a lower rotational speed for controlling the resulting cross-hatch angles on the interior surface 18 of the workpiece 14, which is important when the bore hole 16 will be used with a reciprocating piston, such as in an internal combustion engine. When bore holes 16 are manufactured for such an application, the range of desired angles of intersection of the abrading paths, or cross-hatch angles, of the interior surface 18 is preferable about 30 degrees so that oil will migrate up the interior surface 18 of the bore hole 16. As those in the industry will appreciate, if the cross-hatch angles provided on the interior surface 18 exceed the desired range, consumption of the oil will be excessive. In contrast, if the cross-hatch angles in the interior surface 18 are lower than the desired range, oil will not be able to migrate up the interior surface 18 of bore hole 16 properly. To achieve the desired range of cross-hatch angles so that a stable lubricating film in the bore hole 16 can be ensured, the reciprocating movement rate of the tool 30 is adjusted to be synchronized with the rotational speed of the tool 30. Examples of relative reciprocating axial movement rates and rotational speeds of the tool 30 include rotating the tool 30 at about 350 revolutions per minute and reciprocating the tool at about 100 feet per minute (about 33 meters/minute).

In other honing applications, the range of cross-hatch angles may not be as critical to the performance of the bore hole 16, and as such, the rotational speed of the tool 30 can be increased, depending on the abrasive (e.g., 70) used, such as from about 5,000 to about 20,000 revolutions per minute. In this application, the work engaging surface 52 can be expanded to the desired or effective machining diameter using fluid pressure prior to the tool 30 entering the bore hole 16, and the need to make more than one pass along the interior surface 18 is diminished. In such an application, the feed rate can be lower, from about 5 inches/minute to about 20 inches/minute (12.7 to 50.8 mm/minute). Therefore, the tool 30 does not necessarily axially reciprocate, but instead, is infed and then retracted.

As fluid pressure accumulates in the pressure chamber 46, excess fluid is directed or "leaks" into the plurality of guide channels 54 and exits out of the honing member 50 through openings 55. As described above, the fluid exiting from the openings 55 help to dissipate heat energy, wash away recently ground particles (i.e., chips), and remove particles and shavings from on or around the interior surface 18. Fluid is preferably delivered through the openings 55 from about less than one gallon to about twenty gallons per minute (less than 3.786 liters per minute to about 75 liters per minute).

After the honing operation is completed, fluid pressure in the fluid delivery system 40 is reduced or relieved, whereby the honing member 50 returns to the unexpanded or unextended position shown in FIGS. 2–7, and out of contact or engagement with the finished or polished surface 18. The tool 30 is removed from the hole 16.

Having shown and described the preferred embodiments of the present invention in detail, it will be apparent that modifications and variations by one of ordinary skill in the art are possible without departing from the scope of the present invention defined in the appended claims. Several potential modifications have been mentioned and others will be apparent to those skilled in the art. Accordingly, the scope of the present invention should be considered in terms of the following claims and is understood not to be limited to the details of structure and operation shown and described in the specification and drawings.

I claim:

1. An improved honing device configured for use with a source of pressurized fluid, and comprising:

(a) a tool mandrel;

(b) a substantially rigid honing member secured to said mandrel, said member having an interior surface, an abrasive exterior surface and a longitudinal axis, and said member configured such that said exterior surface is selectively and substantially uniformly expanded in a radial direction relative to the longitudinal axis in response to fluid pressure on said interior surface of said honing member to automatically provide a plurality of predetermined honing diameters as desired; and (c) a fluid distribution system formed in said tool mandrel and in fluid communication with the source of pressurized fluid, said fluid distribution system configured for selectively applying pressurized fluid to said interior surface of said honing member for selectively and substantially uniformly expanding honing member in a radial direction relative to the longitudinal axis.

2. The honing device of claim 1, wherein said honing member comprises a substantially cylindrical structure configured to be slidably received on said tool mandrel.

3. The honing device of claim 1, wherein said honing member is a unitary structure.

4. The honing device of claim 1, wherein said tool mandrel comprises a distal end and an assembly for further maintaining the longitudinal position of said honing member relative to said distal end of said tool mandrel.

5. The honing device of claim 4, wherein said assembly comprises an end cap attached to said tool mandrel.

6. The honing device of claim 4, wherein said assembly and said honing member are a unitary structure.

7. The honing device of claim 1, wherein said honing member further comprises at least one passage and an opening on its exterior surface.

8. The honing device of claim 1, wherein said honing member comprises a substantially uninterrupted honing surface.

9. The honing device of claim 1, wherein said honing member and tool mandrel are secured via an interference-fit to prevent radial and axial movement of said honing member relative to said tool mandrel.

10. The honing device of claim 1, wherein the fluid distribution system further comprises a pressure chamber interposed between a peripheral surface of said tool mandrel and the interior surface of said honing member.

11. The honing device of claim 1, further comprising a connector associated with the tool mandrel, said connector adapted and configured for facilitating quick and automatic placement of said honing device in fluid communication with the source of pressurized fluid.

12. An improved honing device for use with a machine spindle for rotating machining operations and a source of pressurized fluid comprising:

(a) a tool mandrel having a proximal end with a tool holder disposed adjacent thereto, said tool holder having an engaging mechanism adapted and configured for quickly attaching said honing tool to the machine spindle;

(b) a honing member secured to said mandrel, said member being substantially unitary and having an interior surface and an outer surface, said outer surface comprising an abrasive; and, (c) a fluid distribution system in said tool mandrel in fluid communication with the source of pressurized fluid and configured to allow selective application of pressurized fluid to said interior surface of said honing member for selectively and substantially uniformly expanding honing member in a radial direction relative to a longitudinal axis.

13. The honing device of claim 12, further comprising a connector attached to said tool holder and adapted and configured for quickly and automatically placing said honing tool in fluid communication with the source of pressurized fluid upon attachment of the honing tool to the machine spindle.

14. The honing device of claim 12, further comprising an assembly for further maintaining the longitudinal position of said honing member relative to said tool mandrel.

15. The honing device of claim 12, wherein said honing member is substantially rigid and has an exterior surface, and said tool mandrel has a longitudinal axis, said honing member being configured such that said exterior surface is selectively and substantially uniformly expanded in a radial direction relative to the longitudinal axis in response to fluid pressure on said interior surface of said honing member to automatically provide a plurality of predetermined effective honing diameters as desired.

16. An improved method for honing the interior of a workpiece, said method comprising the steps of:

(a) providing a honing device for use with a machine spindle and a source of pressurized fluid, said honing device including:

a tool mandrel;

a substantially rigid honing member secured to said mandrel, said member having an interior surface, an outer surface with an effective honing diameter, and a longitudinal axis, said outer surface comprising an abrasive portion; and, a fluid distribution system in fluid communication with the source of pressurized fluid and configured to selectively apply pressurized fluid to said interior surface of said honing member;

(b) feeding the honing device into the interior of a workpiece to be honed;

(c) rotating the device about said longitudinal axis;

(d) selectively altering the fluid pressure in the fluid delivery system to substantially uniformly modify the effective diameter of the honing member in a radial direction relative to the longitudinal axis of the tool.

17. The method of claim 16, wherein said tool is fed into said workpiece prior to rotating of the device.

18. The method of claim 16, wherein the step of altering said fluid pressure is undertaken while rotating said tool.

19. The method of claim 16, wherein the step of selectively altering the fluid pressure comprises increasing the fluid pressure substantially instantaneously to accomplish a relatively abrupt predetermined change in the effective diameter of honing member.

20. The method of claim 16 further comprising the step of:

providing a connector attached to said tool mandrel for and communication between the source of pressurized fluid and the fluid distribution system; and, connecting said device with the machine spindle and quickly and automatically.

* * * * *

UNITED STATES PATENT AND TRADEMARK OFFICE

CERTIFICATE OF CORRECTION

PATENT NO. : 5,800,252
DATED : September 1, 1998
INVENTOR(S) : Gregory A. Hyatt

It is certified that error appears in the above-identified patent and that said Letters Patent is hereby corrected as shown below:

In claim 1, line 10, replace "fluid pressure" with -- pressurized fluid--.

In claim 1, line 18, insert --the-- after "expanding".

In claim 12, line 17, insert --the-- after "expanding".

In claim 19, line 5, insert --the-- before "honing".

Signed and Sealed this

Second Day of February, 1999

*Attest:*

*Attesting Officer*

*Acting Commissioner of Patents and Trademarks*